US005520024A

United States Patent [19]

Ando'

[11] Patent Number: 5,520,024

[45] Date of Patent: May 28, 1996

[54] SELECTION DEVICE FOR AN ELASTIC SELECTOR FOR NEEDLES IN A CIRCULAR KNITTING MACHINE

[75] Inventor: Jan Ando', Scandicci, Italy

[73] Assignee: Matec S.r.l., Italy

[21] Appl. No.: 415,623

[22] Filed: Apr. 3, 1995

[30] Foreign Application Priority Data

Apr. 15, 1994 [IT] Italy ..... BO94A0161

[51] Int. Cl.[6] ..... D04B 9/00

[52] U.S. Cl. ..... 66/220; 66/75.2; 66/219

[58] Field of Search ..... 66/75.2, 215, 216, 66/218, 219, 220, 221

[56] References Cited

U.S. PATENT DOCUMENTS

| | | | |
|---|---|---|---|
| 3,812,691 | 5/1974 | Engelfried | 66/219 |
| 4,033,148 | 7/1977 | Mureso . | |
| 4,320,635 | 3/1982 | Cuche et al. | 66/220 |
| 4,905,484 | 3/1990 | Schindler | 66/220 |

FOREIGN PATENT DOCUMENTS

| | | | |
|---|---|---|---|
| 474195 | 3/1992 | European Pat. Off. | 66/219 |
| 2030533 | 11/1970 | France . | |
| 2179414 | 11/1973 | France . | |
| 2155196 | 5/1973 | Germany | 66/220 |
| 2254057 | 5/1974 | Germany . | |

*Primary Examiner*—John J. Calvert
*Attorney, Agent, or Firm*—Welsh & Katz, Ltd.

[57] ABSTRACT

A selection device for an elastic selector for needles in a circular knitting machine which includes, in an upward region, an elastic portion that is adapted to move the lower portion towards the outside of the cylinder and has a lower heel that is adapted to move outward into a position for engagement on the part of a lifting cam; the selector continues, in a downward region, with a tab that is adapted to be attracted and retained by a fixed annular permanent magnet which is arranged towards the inside of a cylinder and at which one or more electromagnets are mounted; the activation of the electromagnets is adapted to selectively release the selectors which are otherwise retained by the permanent magnet during the rotation of the cylinder.

4 Claims, 1 Drawing Sheet

SELECTION DEVICE FOR AN ELASTIC SELECTOR FOR NEEDLES IN A CIRCULAR KNITTING MACHINE

BACKGROUND OF THE INVENTION

The present invention relates to a selection device for an elastic selector for needles in a circular knitting machine, particularly for knitting socks or the like.

Conventional circular knitting machines for manufacturing socks or the like have a cylinder that has a usually vertical axis and is affected by a plurality of longitudinal peripheral millings in which respective needles are mounted so that they can slide vertically.

The needles rest, in a downward region, on the top of respective selectors which can also move vertically and can be actuated by respective cam profiles to move upward or downward; in order to be able to modify the characteristics of the product being knitted, certain needles must be raised by a given extent with respect to the elevation at which they are located during the rotation of the cylinder and at specific angular positions.

This is achieved by installing on the machine, at said angular positions, appropriate selection devices which select which needles must be raised and which ones must instead continue in the lowered position.

These devices generally act on a selector that must be arranged at a specifically determined elevation in order to be affected by said device, and this is achieved by means of leveling cams which are arranged around the rotating cylinder, thus causing bulk problems.

Furthermore, most conventional devices select the selector by pressing it towards the inside of the cylinder, and this requires the presence of additional preselection cams that extract all the selectors in their seats towards the outside of the cylinder prior to actual selection, leading to a reduction in the angular portion that is available for selection due to the presence of said extraction cams.

SUMMARY OF THE INVENTION

A principal aim of the present invention indeed is to obviate the above described drawbacks of conventional devices, that is to say, to provide a selection device for an elastic selector for needles in a circular knitting machine that allows to select the needles at will according to the requirements without having to replace parts.

An object of the present invention is to provide a selection device for an elastic selector for needles in a circular knitting machine whose dimensions and weight are limited, so as to allow high operating speeds.

Within the scope of this technical aim, another object of the present invention is to achieve the above aim and objects with a structure that is simple, relatively easy to produce in practice, safe in use, effective in operation, and having relatively low costs.

This aim and these objects are all achieved by the present selection device for an elastic selector for needles in a circular knitting machine which comprises, in an upward region, an elastic portion that is adapted to move the lower portion towards the outside of the cylinder and has a lower heel that is adapted to move outward into a position for engagement on the part of a lifting cam, characterized in that said selector continues, in a downward region, with a tab that is adapted to be attracted and retained by a fixed annular permanent magnet which is arranged towards the inside of the cylinder and at which one or more electromagnets are mounted, the activation of said electromagnets being adapted to selectively release the selectors which are otherwise retained by the permanent magnet during the rotation of the cylinder.

BRIEF DESCRIPTION OF THE DRAWINGS

Further characteristics and advantages of the present invention will become apparent and more clearly understood from the detailed description of a preferred but not exclusive embodiment of a selection device for an elastic selector for needles in a circular knitting machine according to the invention, illustrated only by way of non-limitative example in the accompanying drawings, wherein.

DESCRIPTION OF THE PREFERRED EMBODIMENTS

Figure 1:
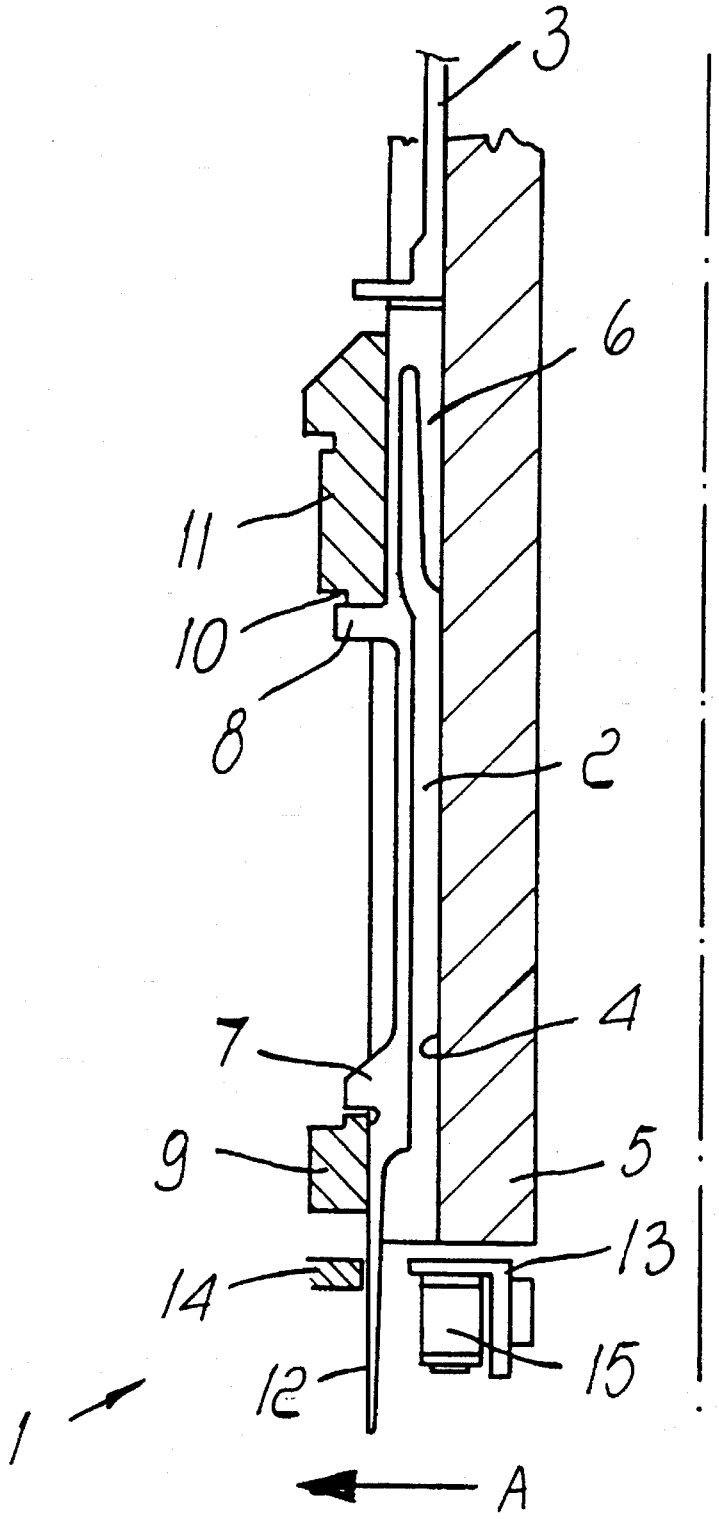
FIG. 1 is a schematic sectional side view, taken along a vertical plane, of a selection device for an elastic selector for needles in a circular knitting machine according to the invention.

With particular reference to the above FIGURE, the reference numeral 1 generally designates a selection device for an elastic selector 2 for needles 3 in a circular knitting machine according to the invention.

The selectors and the needles are mounted in a conventional manner at respective longitudinal millings 4 which are distributed over the lateral surface of a cylinder 5.

The elastic selector 2 is of the type which has, in an upward region, a U-shaped contoured elastic portion 6 which is folded back, is slidingly guided inside a corresponding longitudinal milling 4 with a part thereof in constant abutment with the lateral surface of the cylinder 5, and is adapted to urge the lower portion towards the outside of the cylinder (arrow A); the selector has a lower heel 7 and an upper heel 8.

The lower heel 7 is adapted to return elastically outward into a position for being engaged by a lifting cam 9 or to be retained towards the axis of the cylinder in a configuration in which it does not interact with the cam 9.

The upper heel 8 is actuated downward by a lowering cam 10 which is formed on the lower surface of a complementary ring 11 for retaining the portions 6 of the selectors 2.

In a downward region, the selectors continue with a narrower tab 12 which is adapted to be attracted and retained by a fixed annular permanent magnet 13 which is arranged towards the inside of the cylinder: a retraction cam 14 is mounted radially outwardly from the cylinder and is adapted to move the tab 12, at each turn of the cylinder, so that it makes contact with the permanent magnet: when the tab 12 is retained by the magnet 13, the heel 7 reaches the configuration for not interacting with the cam 9.

A plurality of small electromagnets 15 are mounted at the permanent magnet 13; for countering the magnetic force thereof their activation is adapted to cause the selective release of the selectors, which are otherwise retained by the permanent magnet during the rotation of the cylinder.

The operation of the selection device according to the invention is as follows: during the rotation of the cylinder, the selectors are moved by the cam 14 so that the tabs 12 are retained by virtue of the magnetic ring 13 and so that the heels do not interact with the cam 9: depending on the requirements, the electromagnets 15 are activated and cause the release of the selectors as they pass in front of them; the heel 7 of the selected selector reaches the configuration in which it interacts with the cam 9, which can thus raise it; then the cam 10 returns the selector to the lowered position.

It should be noted that in the described device it is not necessary for the selectors 2 to be selected when they are at a specific elevation, because by giving the tab 12 an appropriate preset length it is possible to selectively disengage the selectors when they pass at different elevations in front of the electromagnet.

Furthermore, the device according to the invention is very compact and has small dimensions, since, in practice, it entails the placing of the magnet 13 and the electromagnets 15 only radially inwardly with respect to the lateral surface of the cylinder 5.

The invention thus conceived is susceptible of numerous modifications and variations, all of which are within the scope of the inventive concept.

All the details may furthermore be replaced with other technically equivalent ones.

In practice, the materials employed, as well as the shapes and dimensions, may be any according to the requirements without thereby abandoning the protective scope of the appended claims.

What is claimed is:

1. In a circular knitting machine having a rotating needle cylinder with longitudinal peripheral millings distributed on a lateral surface thereof, each of said millings slidingly guiding a needle, a selection device for selecting the needles to be raised and those to be left lowered, said selector device comprising:

elastic selectors, one for each of said needles, each one of said selectors having an upper region and a lower region, said upper region including a U-shaped elastic portion with a back-folded part, said back-folded part urging said lower region radially outwardly with respect to said cylinder, said elastic portion being slidingly guided in a respective one of said longitudinal millings with said back-folded part thereof in constant abutment with the lateral surface of the cylinder, said lower region comprising a tab;

a fixed annular permanent magnet for attracting and retaining the tabs of the selectors, said permanent magnet being oriented radially inwardly with respect to said lateral surface of the cylinder;

at least one electromagnet which is activatable for selectively releasing said tabs being otherwise retained by the permanent magnet during rotation of said cylinder, said at least one electromagnet being mounted inwardly with respect to said lateral surface of the cylinder at said permanent magnet for countering the magnetic force of the permanent magnet.

2. In a circular knitting machine, the selection device as set forth in claim 1, wherein each one of said elastic selectors comprises an upper heel and a lower heel, said upper and lower heels being engageable by cam profiles of said knitting machine for respectively lowering and lifting said selectors along said longitudinal millings.

3. In a circular knitting machine, the selector device as set forth in claim 1, wherein said tabs have preset lengths allowing selective disengagement of the selectors which pass, upon rotation of said cylinder, at different elevations in front of said at least one electromagnet.

4. In a circular knitting machine, the selector device as set forth in claim 1, further including a retraction cam, said retraction cam being mounted radially outwardly from the cylinder for moving said tabs so as to contact said permanent magnet.

* * * * *